US007500587B2

(12) United States Patent
Akiba et al.

(10) Patent No.: US 7,500,587 B2
(45) **Date of Patent: *Mar. 10, 2009**

(54) COMBUSTION-TYPE POWER TOOL

(75) Inventors: Yoshitaka Akiba, Hitachinaka (JP); Tomomasa Nishikawa, Hitachinaka (JP); Kunio Yamamoto, Hitachinaka (JP); Shinki Ohtsu, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/542,155

(22) Filed: Oct. 4, 2006

(65) Prior Publication Data

US 2007/0034661 A1 Feb. 15, 2007

Related U.S. Application Data

(63) Continuation of application No. 11/108,734, filed on Apr. 19, 2005, now Pat. No. 7,121,442.

(30) Foreign Application Priority Data

Apr. 19, 2004 (JP) ..... P2004-123501
Feb. 18, 2005 (JP) ..... P2005-043281

(51) Int. Cl.
*B25C 1/08* (2006.01)

(52) U.S. Cl. ..... 227/10; 227/130

(58) Field of Classification Search ..... 227/10, 227/130, 8; 123/46 SC
See application file for complete search history.

(56) References Cited

U.S. PATENT DOCUMENTS

| | | | | |
|---|---|---|---|---|
| 4,483,474 | A * | 11/1984 | Nikolich | 227/8 |
| 5,530,304 | A * | 6/1996 | Mirumachi et al. | 310/51 |
| 5,713,313 | A * | 2/1998 | Berry | 123/46 SC |
| 6,262,504 | B1 * | 7/2001 | Bartlett | 310/89 |
| 6,520,397 | B1 | 2/2003 | Moeller | |
| 6,619,527 | B1 * | 9/2003 | Moeller | 227/10 |
| 6,779,699 | B2 * | 8/2004 | Aoki et al. | 227/130 |
| 7,073,468 | B2 * | 7/2006 | Akiba et al. | 123/46 SC |
| 7,121,442 | B2 * | 10/2006 | Akiba et al. | 227/10 |
| 7,152,695 | B2 * | 12/2006 | Happ et al. | 173/217 |
| 7,225,768 | B2 * | 6/2007 | Akiba et al. | 123/46 SC |
| 2004/0050901 | A1 | 3/2004 | Turk | |
| 2004/0173657 | A1 | 9/2004 | Turk | |

FOREIGN PATENT DOCUMENTS

EP 1 488 891 12/2004

* cited by examiner

*Primary Examiner*—Scott A. Smith
(74) *Attorney, Agent, or Firm*—Antonelli, Terry, Stout & Kraus, LLP.

(57) ABSTRACT

A combustion-type power tool includes a housing, a cylinder head disposed at one end of the housing, a cylinder in the housing, a piston slidably disposed in the cylinder, and a driver blade connected to the piston. A combustion-chamber is provided in the housing, a fan is disposed in the combustion chamber, and a motor having an output shaft is coupled to the fan. A motor holder accommodates the motor, and the cylinder head is formed with a motor holder receiving portion in which the motor holder is slidably movably disposed. An elastic member is disposed in a gap formed between the motor holder and the motor holder receiving portion.

14 Claims, 12 Drawing Sheets

COMBUSTION-TYPE POWER TOOL

CROSS REFERENCE TO RELATED APPLICATION

This application is a continuation of U.S. application Ser. No. 11/108,734, filed Apr. 19, 2005, now U.S. Pat. No. 7,121,442 the contents of which is incorporated herein by reference.

BACKGROUND OF THE INVENTION

1. Field of the Invention

The present invention relates generally to a combustion-type power tool, such as combustion-type nail driver for striking fastening members such as nails or studs into a workpiece wherein acceleration applied to a motor when combustion explosion occurs or a piston impinges upon a bumper is suppressed.

2. Description of the Related Art

A combustion-type nail driver ignites air-fuel mixed gas confined in a combustion chamber and translates voluminal expansion of the gas into power. A fan is disposed within the combustion chamber to stir air and fuel to enhance the combustion property of the mixed gas.

The fan is rotated by a motor. The fan generates turbulence of the mixed gas in the combustion chamber and promotes combustion of the gas. Occurrence of explosive combustion in the combustion chamber brings the voluminal expansion of the gas and generates impact. The impact thus generated is transmitted to the body of the nail driver, and so to the motor for rotating the fan.

A piston that translates the voluminal expansion of the gas into power strikes a nail into a workpiece. A kinetic energy in excess of the energy required for striking the nail into the workpiece is absorbed into a bumper disposed in the cylinder along which the piston slidingly moves when the piston impinges upon the bumper. At this time, acceleration generated when the piston impinges upon the bumper is applied to the body of the nail driver, and the acceleration thus generates is transmitted to the motor.

Because the motor is a precise device and is weak against vibration. The motor may be damaged by the impact repeatedly applied to the motor, resulting in degradation of the property of the motor. In order not to transmit the impact to the motor, a buffer material is used for a motor holding member. The motor holding member separates the motor from the body of the nail driver, thus transmission of the impact to the motor can be prevented, as disclosed in U.S. Pat. No. 6,520,397.

More specifically, as shown in FIGS. 1 and 2, a motor 118 is mounted on a cylinder head 111. The cylinder head 111 is disposed at one end portion of a housing 102 of the nail driver 101 and covered by a head cover 103. A fan 119 is attached to the tip end of the output shaft 118*b* of the motor 118. A spark plug 112 fixedly secured to the cylinder head 111 is positioned in the vicinity of the motor 118 and has one end projected into the combustion chamber.

Two circumferentially extending grooves are formed over the entire outer periphery of the motor 118 to be spaced apart in the axial direction of the motor 118. As shown in FIG. 1, a retaining ring 114 is fitted into each of the two grooves. An inner ring 113*a* of a buffer member 113 is interposed and held between the two retaining rings 114.

As shown in FIG. 2, the buffer member 113 includes the inner ring 113*a*, a fixing metal member 113*c*, and a rubber member 113*b* molded and coupled to both the inner ring 113*b* and the fixing metal member 113*c* to be integral thererwith.

The fixing metal member 113*c* is fixedly secured to the cylinder head 111. As such, the motor 118 is supported on the cylinder head 111 is via the buffer member 113.

With the above-described structure, impact generated in the nail driver 101 is transmitted to the fixing metal member 113*c* of the buffer member 113. However, due to the presence of the rubber member 113*b*, the impact transmitted to the inner ring 113*a* and to the motor 118 supported by holding the inner ring 113 with the retaining rings 114 is suppressed.

However, as described above, with the conventional nail driver, the grooves need to be formed in the outer periphery of the motor 118 in order to fix the motor 118 to the buffer member 113. Therefore, general-purpose motors cannot be employed but motors manufactured based on a special specification, which are expensive in cost, are required. The buffer member 113 is an integral member in which the two metal rings 113*a* and 113*c* are connected together with the rubber member 113*b* interposed therebetween. Due to the different materials forming the integrated buffer member 113, reliability of rubber mold coupling is low and there is a possibility that the different material segments are separated if the rubber molding condition is not good.

From the structural requirement, the spark plug 112 is positioned in the vicinity of the motor. Accordingly, the rubber member 113 cannot extend to the position of the spark plug 112. Continuity of the rubber member 113 is thus interrupted by the spark plug 112 and the rubber member 113 is separated at the position of the spark plug 112. The buffer member 113 is incapable of equally suppressing the impact to be imparted upon the motor 118. Tensile stress is thus focused on a position near the spark plug securing position, so that the rubber member 113*b* is liable to be damaged.

In the nail driver of the type described above, continuously performed nail driving operations accumulate heat generated at the time of explosive combustion. The combustion chamber 26 and the cylinder (not shown) are the primary sources of heat generation. The heat thus generated is transmitted to and raises the temperature of the nail driver including the motor 118. Driving the motor 118 also generates heat in the motor coil, so further raises the temperature of the motor 118. A problem that temperature rise of the motor 118 may cause burning of the motor 118 has conventionally been solved by employing highly durable motors. However, such motors are expensive in cost.

SUMMARY OF THE INVENTION

It is therefore an object of the present invention to dissolve the above-described problems accompanying the conventional power tool and to provide a combustion-type power tool with an easily manufacturable and less-damageable motor supporting structure.

Another object of the present invention is to provide a combustion-type power tool that is inexpensive in cost and has a motor supporting structure of an improved cooling efficiency.

To achieve the above and other objects, there is provided a combustion-type power tool that includes a housing, a cylinder head, a cylinder, a piston, a driver blade, a combustion-chamber frame, a fan, a motor, a motor holder, and an elastic member. The cylinder head is disposed near one end of the housing and formed with a fuel ejection port and an air inlet port. The cylinder is secured to an inside of the housing. The piston is slidably disposed in the cylinder and reciprocally movable in an axial direction of the cylinder. The piston divides the cylinder into an upper cylinder space above the piston and a lower cylinder space below the piston. The driver blade is connected to the piston to be movable therewith. The combustion-chamber frame is movably provided in the housing. The combustion-chamber frame has one end abuttable on and separable from the cylinder head. A combination of the combustion-chamber frame, the cylinder head and the piston define a combustion chamber. The fan is disposed in the combustion chamber. The motor has an output shaft coupled to the fan. The motor holder accommodates the motor. The cylinder head is formed with a motor holder receiving portion in which the motor holder is slidably movably disposed. The elastic member, such as a coil spring, is disposed in a gap formed in the axial direction between the motor holder and the motor holder receiving portion. The elastic member is elastically deformable when the motor holder slidingly moves relative to the motor holder receiving portion.

The coil spring used as the elastic member has one end secured to the motor holder and another end secured to the motor holder receiving portion.

It is preferable that the motor holder has an outer surface formed with a plurality of protrusions for firmly holding the motor.

It is also preferable that a heat shielding member such as disk is disposed in the motor holder and in a position between the body of the motor and the combustion chamber for preventing heated gas generated at the time of combustion from entering into the motor and for prolonging the service life of the motor.

It is preferable that a low frictional member is interposed between an inner surface of the motor holder receiving portion and an outer surface of the motor holder, wherein the low frictional member has a friction factor lower than a friction factor of the cylinder head.

It is preferable that the motor holder is formed from a metal for dissipating heat. The motor holder may further be formed with a cooling fin. For the cooling purpose, it is further preferable to provide an air flow guide member disposed above the cylinder head for guiding fresh air to flow along the upper surface of the cylinder head confronting the air flow guide member.

DETAILED DESCRIPTION OF THE PREFERRED EMBODIMENTS

A combustion-type power tool according to an embodiment of the invention will be described with reference to FIGS. 3 through 7. The embodiment pertains to a combustion-type nail driver. In the following description, the terms "upper", "lower", "above", "below", "upward", "downward" and the like will be used assuming that the combustion-type nail driver is disposed in an orientation in which a nail is fired vertically downward.

Figure 1:
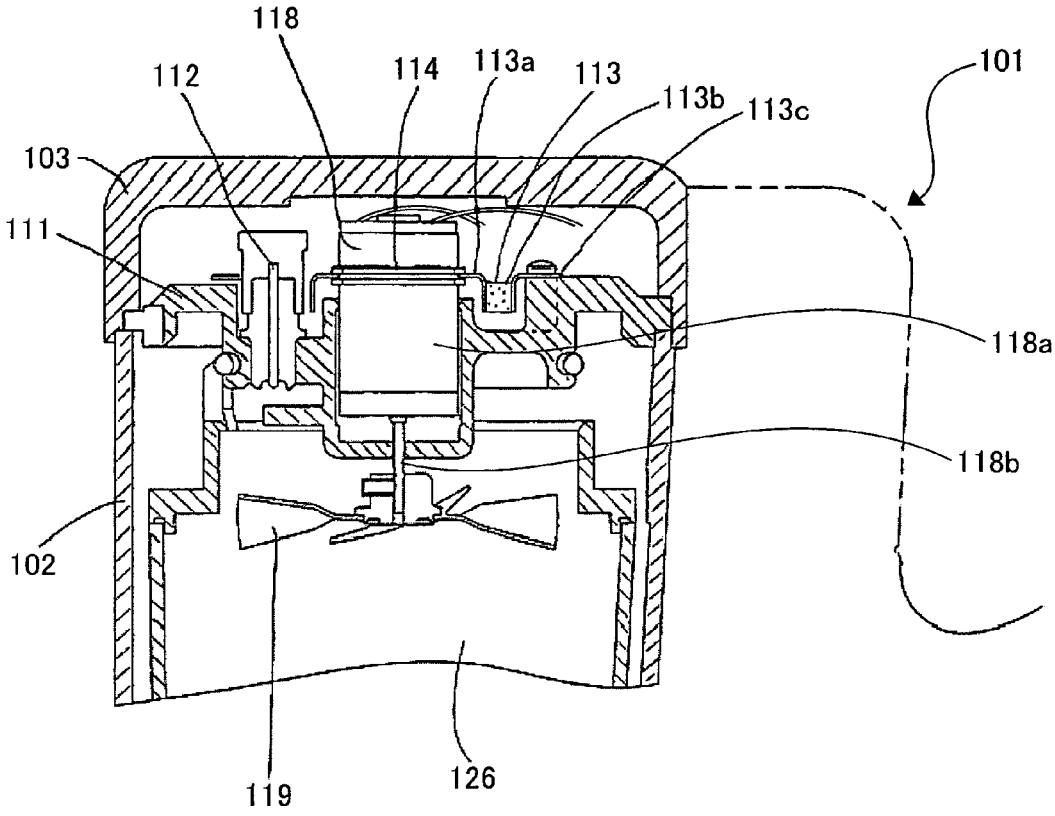
FIG.1 PRIOR ART
FIG. 1 is a cross-sectional side view showing a conventional cylinder head and its associated components.
Figure 2:
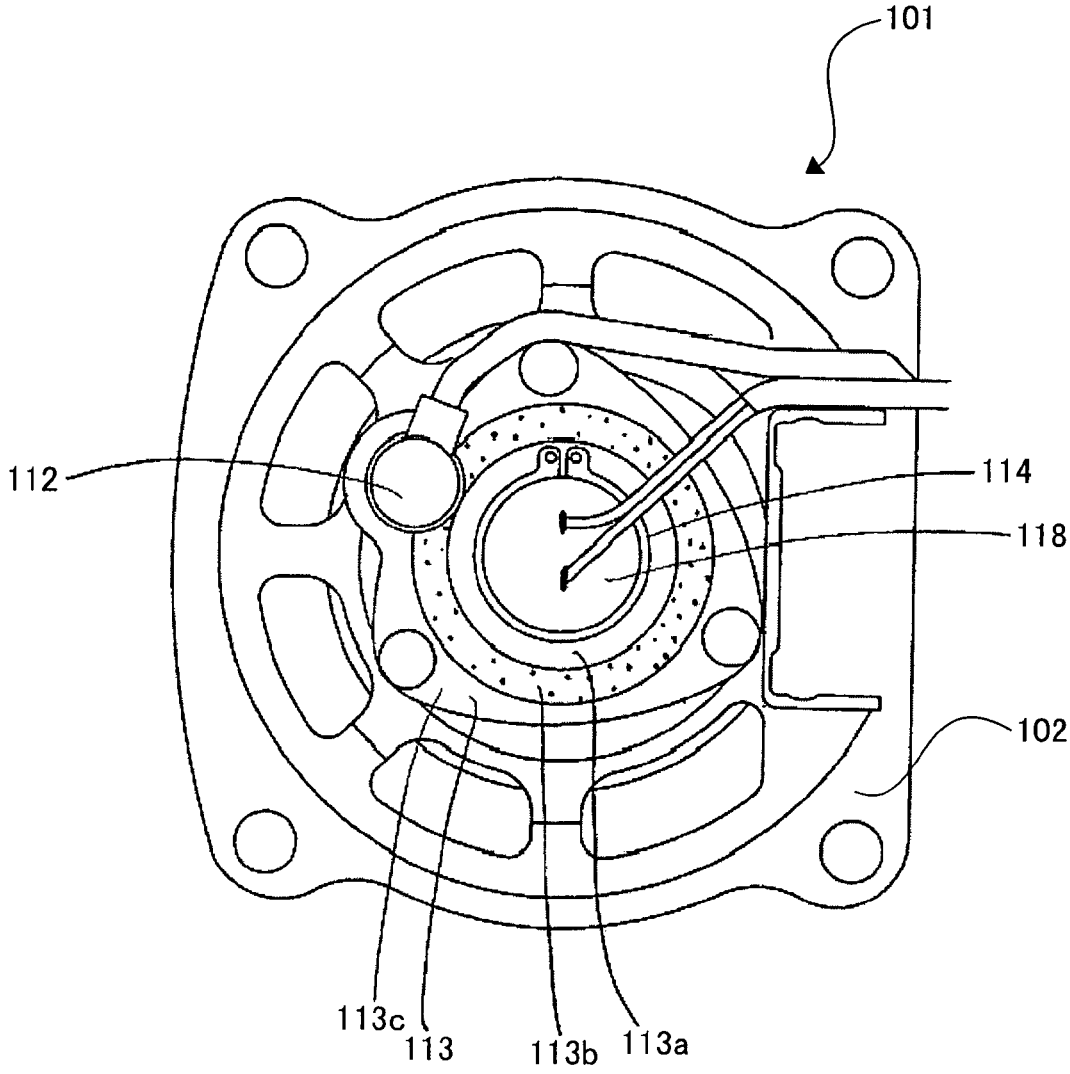
FIG.2 PRIOR ART
FIG. 2 is a cross-sectional top view showing the conventional cylinder head and its associated components.
Figure 3:
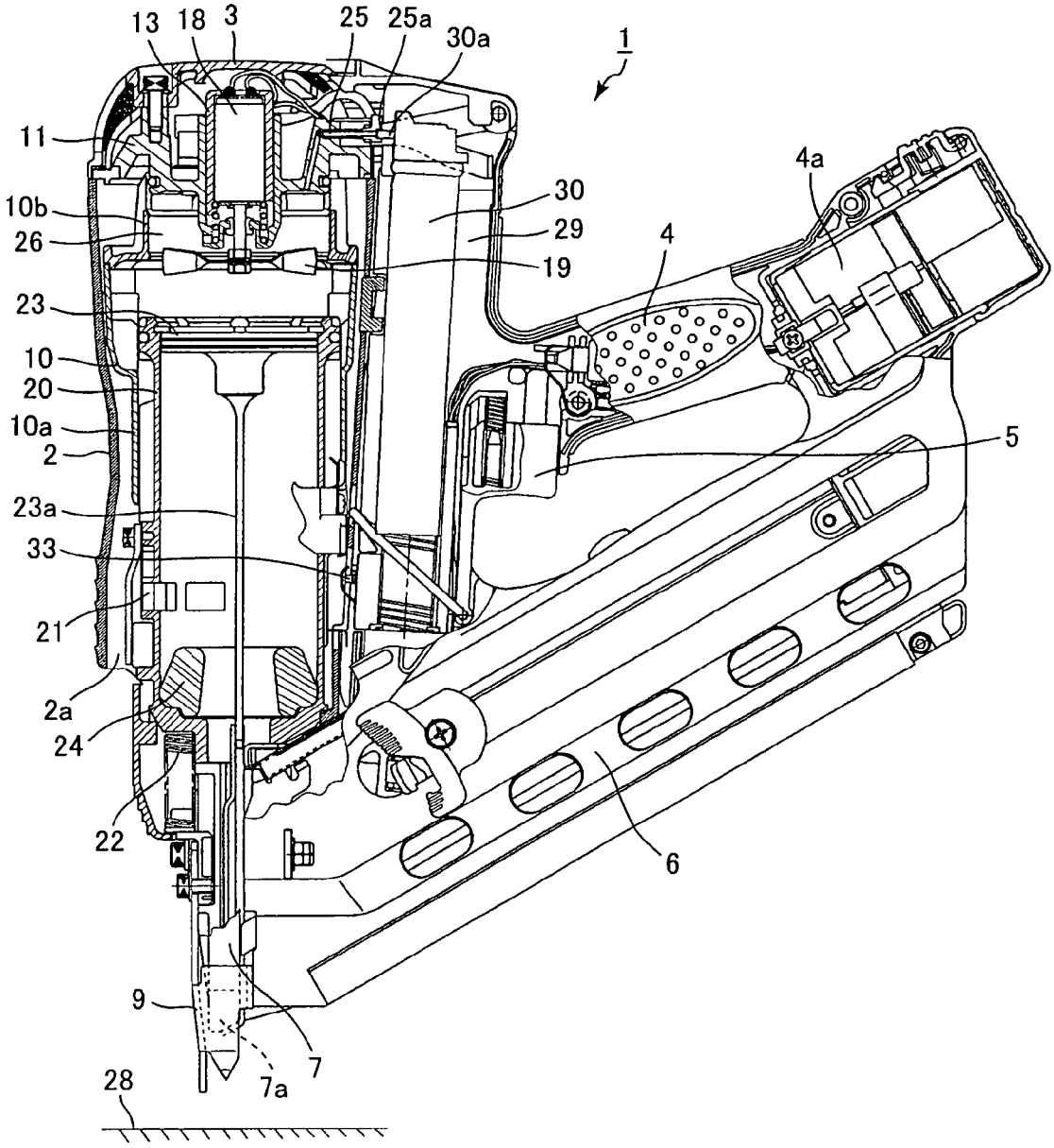
FIG. 3 is a cross-sectional side view showing a combustion-type nail driver according to a first embodiment of the present invention.
Figure 4:
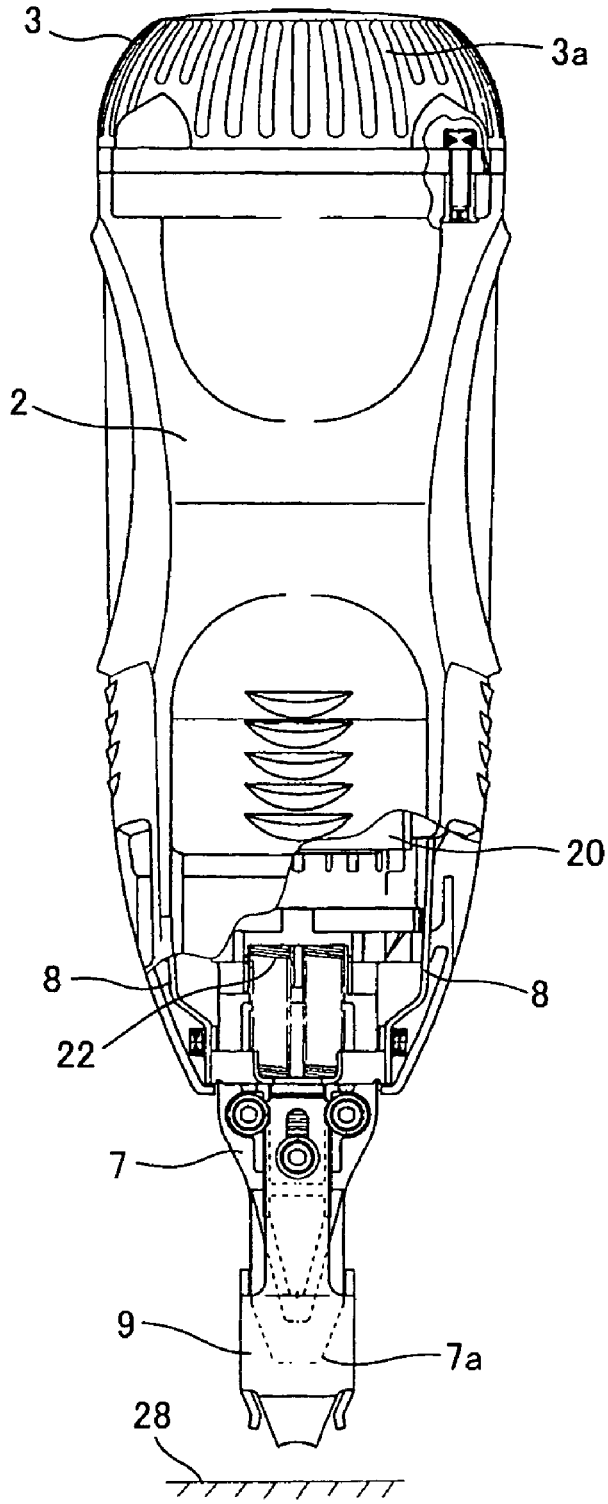
FIG. 4 is a side view showing the combustion-type nail driver according to the first embodiment of the present invention.

The combustion-type nail driver 1 shown in FIG. 3 has a housing 2 constituting an outer frame. A head cover 3 formed with an intake port 3*a* is mounted on the top of the housing 2. A handle 4 extends from one side of the housing 2. The handle 4 has a trigger switch 5 and detachably accommodates therein a battery pack 4*a*. The combustion-type nail driver 1 also has a canister housing 29 at one side of the housing 2 from which the handle 4 extends. A gas canister 30 containing therein a combustible liquidized gas is detachably installable in the canister housing 29. A magazine 6 accommodating therein a bundle of nails (not shown) is disposed below the handle 4.

A nose 7 extends from near the lower end of the housing 2. The nose 7 is integral with a cylinder 20 described later and has a tip end abuttable on a workpiece 28. The nose 7 is adapted for guiding sliding movement of a driver blade 23*a* described later and for guiding the nail driven into the workpiece 28. A push lever 9 is reciprocally slidingly movably supported to the nose 7, and projects from the tip end 7*a* of the nose 7. The push lever 9 has an upper end abuttingly associated with an arm section 8 fixed to a combustion-chamber frame 10 described later. A compression coil spring 22 serving as a biasing member is interposed between the arm section 8 and the cylinder 20. Thus, the push lever 9 abuttingly associated with the arm section 8 is urged downwardly by the biasing force of the compression coil spring 22.

Figure 5:
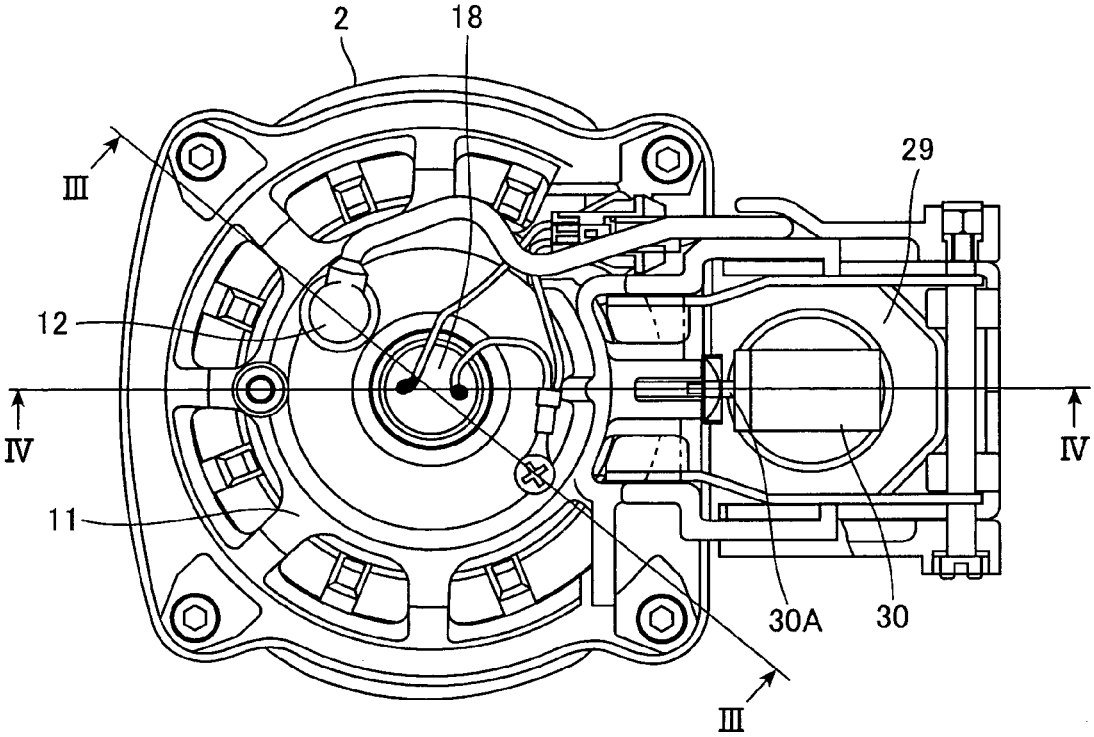
FIG. 5 is a cross-sectional top view showing the combustion-type nail driver according to the first embodiment of the present invention.

A cylinder head 11 is fixedly secured to the top of the housing 2 and substantially covers the open top end of the housing 2. As shown in FIG. 5, a motor 18 is disposed at one side of the cylinder head 11 opposite the combustion chamber 26 as will be described later. An ignition plug 12 is disposed in the vicinity of the motor 18 and the ignition position is directed toward the combustion chamber 26.

Figure 6:
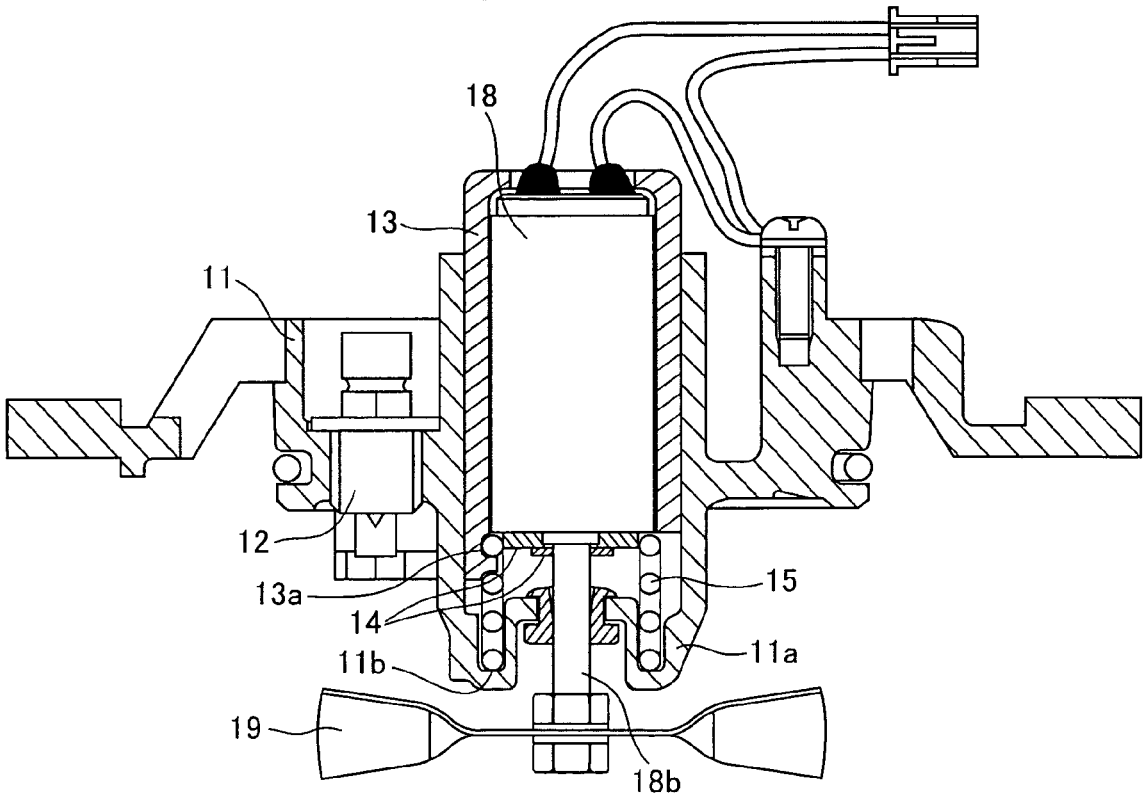
FIG. 6 is a cross-sectional view cut along a line III-III in FIG. 5 showing a cylinder head and its associated components according to the first embodiment of the present invention.
Figure 7:
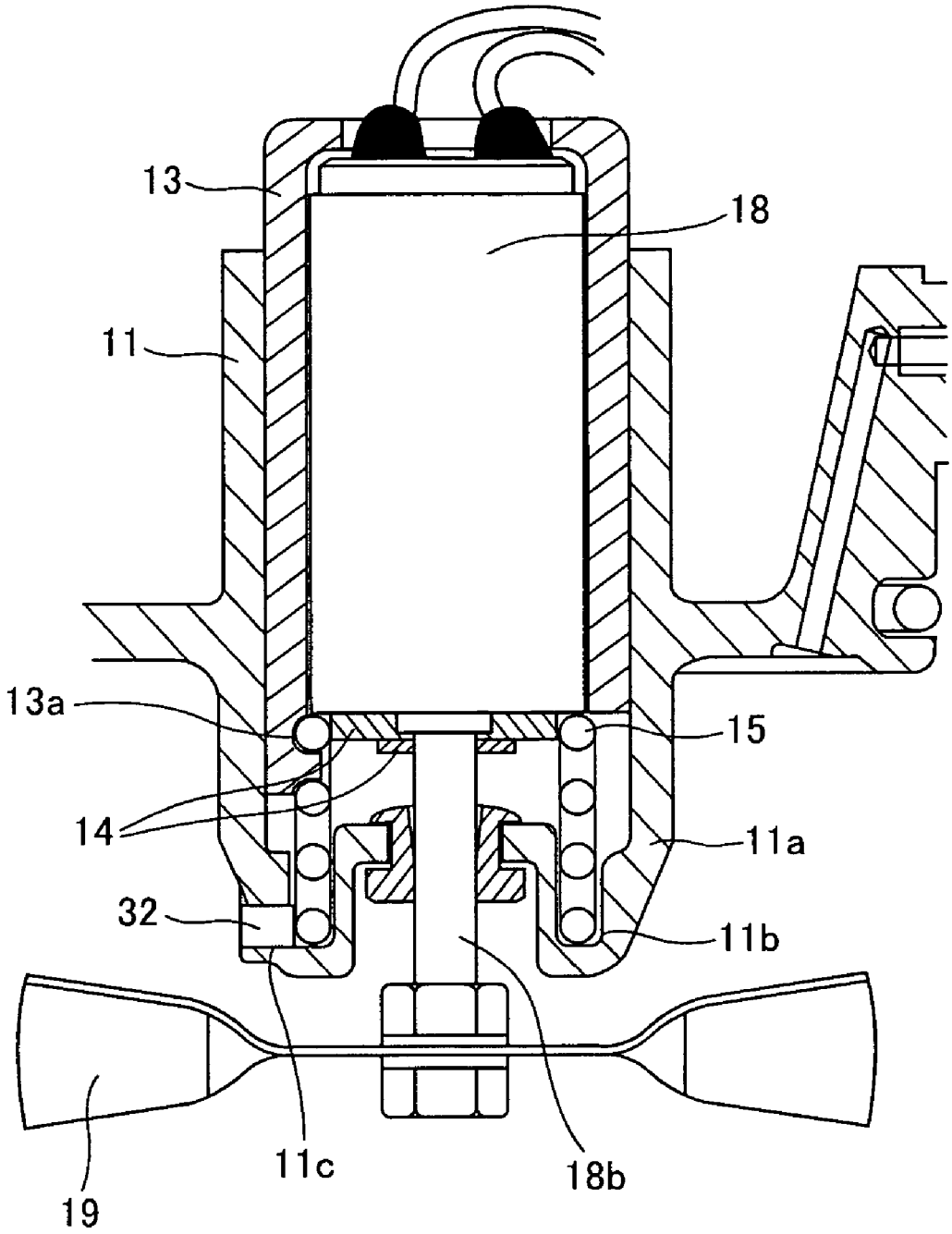
FIG. 7 is a cross-sectional view cut along a line IV-IV in FIG. 5 showing a cylinder head and its associated components according to the first embodiment of the present invention.

As shown in FIG. 6, a motor holder 13 serving as a motor accommodating member is in the form of a hollow cylinder made from resin such as plastic. The motor holder 13 has a hole through which lead lines of the motor 18 are drawn upward. A motor holder receiving portion 11*a* is formed in the cylinder head 11 for receiving the motor holder 13. The motor holder 13 is formed with a groove 13*a* at the lower inner periphery thereof adapted to receive an end portion of a coil spring 15. The motor holder receiving portion 11*a* is also formed with a groove 11*b* at the lower inner periphery thereof to receive another end portion of the coil spring 15. The motor 18 is inserted into the motor holder 13 from its lower end. Then, one end portion of the coil spring 15 is inserted into the groove 13*a* of the motor holder 13 and the other end portion into the groove 11*b* of the motor holder receiving portion 11*a*. As shown in FIG. 7, the other end portion of the coil spring 15 inserted into the groove 11*b* of the motor holder receiving portion 11*a* is fixedly held by a screw 32. The coil spring 15 interposed between the motor 18 and the cylinder head 11 serves to suppress the initial acceleration which may be imparted upon the motor 18.

The motor holder 13 has a dimension such that the inner diameter thereof is slightly larger than the outer diameter of the motor holder receiving portion 11*a*, thereby allowing the motor holder 13 to slidingly move along the inner periphery of the motor holder receiving portion 11*a*. Impact generated at the time of firing the nails is imparted upon the motor holder 13 to move the latter back and forth. However, due to friction between the outer periphery of the motor holder 13 and the inner periphery of the motor holder receiving portion 11*a*, little impact is received at the motor 18.

A disk 14 serving as a heat shielding member is disposed in the motor holder 13 and in a position between the body of the motor 18 and the combustion chamber 10. More specifically, the disk 14 is formed with a center hole into which the output shaft 18*b* of the motor 18 is fitted. The disk 14 is disposed at a position remote from the end portion of the output shaft 18*b* to which the fan 19 is attached. The disk 14 prevents heat wind generated in the combustion chamber 26 from entering into the motor 18 through a gap between the cylinder head 11 and the motor output shaft 18*b*.

Referring back to FIG. 3, a switch 33 is provided in the housing 2 for detecting an uppermost stroke end position of the combustion-chamber frame 10 described later when the nail driver 1 is pressed against the workpiece 28. Thus, the switch 33 can be turned ON when the push lever 9 is elevated to a pre-determined position for starting rotation of the motor 18.

The cylinder head 11 has a handle side in which is formed a fuel ejection passage 25 which allows a combustible gas to pass therethrough. One end of the ejection passage 25 opens at the lower surface of the cylinder head 11. Another end of the ejection passage 25 serves as a gas canister connecting portion 25*a* in communication with a gas canister 30.

The combustion-chamber frame 10 is provided in the housing 2 and is movable in the lengthwise direction of the housing 2. The uppermost end of the combustion-chamber frame 10 is abuttable on the lower surface of the cylinder head 11. A combustion chamber includes a chamber 10*a* and a chamber head 10*b* connected integrally using a bolt (not shown). Since the arm section 8 is connected to the combustion-chamber frame 10, the combustion-chamber frame 10 is moved in accordance with the movement of the push lever 9. The cylinder 20 is fixed to the housing 2. An outer peripheral surface of the cylinder 20 is in sliding contact with the inner circumference of the combustion-chamber frame 10 for guiding the movement of the combustion-chamber frame 10. The cylinder 20 has an axially intermediate portion formed with an exhaust hole 21. An exhaust-gas check valve (not shown) is provided to selectively close the exhaust is hole 21.

As shown in FIG. 3, a piston 23 is slidably and reciprocally movably provided in the cylinder 20. The piston 23 divides an inner space of the cylinder 20 into an upper space above the piston 23 and a lower space below the piston 23. The driver blade 23*a* extends downwards from the lower surface of the piston 23 to the nose 7, so that the tip end of the driver blade 23*a* can strike against the nail (not shown). A bumper 24 made from an elastic material such as rubber is disposed at a lower side of the cylinder 20. The piston 23 strikes against the bumper 24 when the piston 23 is moved downward toward a bottom dead center.

When the upper end of the combustion-chamber frame 10 abuts the cylinder head 11, the cylinder head 11, the combustion-chamber frame 10, and the upper cylinder space above the piston 23 define a combustion chamber 26. When the combustion-chamber frame 10 is separated from the cylinder head 11, a first flow passage in communication with the atmosphere is provided between the cylinder head 11 and the upper end of the combustion-chamber frame 10, and a second flow passage in communication with the first flow passage is provided between the inner peripheral surface of the combustion-chamber frame 10 and the outer peripheral surface of the cylinder 20. The housing 2 has a lower portion formed with an exhaust port 2*a*. The first and second flow passages allow a combustion gas and a fresh air to pass along the outer peripheral surface of the cylinder 20 for discharging these gases through the exhaust port 2*a* of the housing 2. Further, the above-described intake port is formed for supplying a fresh air into the combustion chamber 26, and the exhaust hole 21 discharges combustion gas generated in the combustion chamber 26.

A fan 19 is attached to the lower end of the motor output shaft 18*b* with two nuts. The fan 19 is disposed in the combustion chamber 26. Rotation of the fan 19 performs the following three functions. First, the fan 19 stirs and mixes the air with the combustible gas as long as the combustion-chamber frame 10 remains in abutment with the cylinder head 11. Second, after the mixed gas has been ignited, the fan 19 causes turbulence of the air-fuel mixture, thus promoting the turbulent combustion of the air-fuel mixture in the combustion chamber 26. Third, the fan 19 performs scavenging such that the exhaust gas in the combustion chamber 26 can be scavenged therefrom and also performs cooling of the cylinder 20 when the combustion-chamber frame 10 moves away from the cylinder head 11 and when the first and second flow passages are provided.

Operation of the combustion-type nail driver 1 will next be described. In the non-operational state of the combustion-type nail driver 1, the push lever 9 is biased downward by the biasing force of the compression coil spring 22, so that the push lever 9 protrudes from the lower end of the nose 7. Thus, the uppermost end of the combustion-chamber frame 10 is spaced away from the cylinder head 11 because the combustion-chamber frame 10 is in association with the push lever 9 through the arm section 8. Further, a part of the combustion-chamber frame 10 which part defines the combustion chamber 26 is also spaced apart from the top portion of the cylinder 20. Hence, the first and second flow passages are provided. In this condition, the piston 23 stays at the top dead center in the cylinder 20.

With this state, if the push lever 9 is pushed onto the workpiece 28 while holding the handle 4 by a user, the push lever 9 is moved upward against the biasing force of the compression coil spring 22. At the same time, the combustion-chamber frame 10 which is connected to the push lever 9 through the arm section 8 is also moved upward, closing the first flow passage and hermetically sealing the combustion chamber 26.

In accordance with the movement of the push lever 9, the gas canister 30 is tilted toward the cylinder head 11. Thus, the injection rod 30*a* of the gas canister 30 is pressed against a gas canister connecting portion 25*a* of the cylinder head 11.

Therefore, the liquidized combustible gas in the gas canister 30 is ejected once from the ejection port of the fuel ejection passage 25 into the combustion chamber 26.

Further, in accordance with the movement of the push lever 9, the combustion-chamber frame 10 reaches the uppermost stroke end whereupon the switch 33 is turned ON to supply electric power to the motor 18 and start rotation of the fan 19. Rotation of the fan 19 in the combustion chamber 26 in which a hermetically sealed space is provided, stirs and mixes the ejected combustible gas with air in the combustion chamber 26.

In this state, when the trigger switch 5 provided at the handle 4 is turned ON, spark is generated at the ignition plug 12 to ignite the combustible gas. As a result of combustion, volumetric expansion of the combustion gas occurs within the combustion chamber 26 to move the piston 23 downwardly. Accordingly, the driver blade 23*a* drives the nail held in the nose 7 into the workpiece 28 until the piston 23 strikes against the bumper 24.

After the nail driving, the piston 23 strikes against the bumper 24, and the combustion gas is discharged out of the cylinder 20 through the exhaust hole 21 of the cylinder 20. A check valve (not shown) is provided at the exhaust hole 21. When the inner space of the cylinder 20 and the combustion chamber 26 becomes the atmospheric pressure, the check valve is closed.

Impact is imparted upon the fan 19 when the air-fuel mixed gas is ignited. The motor 18 connected to the fan 19 is applied with resultant acceleration. Striking the piston 23 against the bumper 24 consumes kinetic energy of the piston 23 in excess of energy necessary for driving the nail. Acceleration resulting from the excessive energy is applied to the nail driver 1 including the motor 18. The motor 18 is mounted on the cylinder head 11 and is held thereon with only the elastically deformable spring 15. Therefore, although large acceleration is applied to the motor 18, expansion and compression behavior of the spring 15 absorb the energy to be applied to the motor 18. Thus, impact imparted upon the motor 18 is greatly reduced. Surface contact of the outer peripheral surface of the motor holder 13 with the inner wall of the motor holder receiving portion 11*a* suppresses transmission of the impact to the motor 18.

Combustion gas still remaining in the cylinder 20 and the combustion chamber 26 has a high temperature at a phase immediately after the combustion. The heat is absorbed through the inner surfaces of the cylinder 20 and the combustion-chamber frame 10, and the temperature of these components is also increased. However, the absorbed heat is released to the atmosphere through the outer surfaces of the cylinder 20 and the combustion-chamber frame 10.

Combustion heat of the combustion gas is absorbed into such components as the cylinder 20, so that the combustion gas is abruptly cooled down and a volume of the combustion gas is decreased. Thus, the pressure in the sealed space in the cylinder 20 above the piston 23 further drops to less than the atmospheric pressure, creating a so-called "thermal vacuum". Accordingly, the piston 23 is moved back to the initial top dead is center position.

Thereafter, the trigger switch 5 is turned OFF, and the user lifts the nail driver 1 until the push lever 9 is separated from the workpiece 28. As a result, the push lever 9 and the combustion-chamber frame 10 move downward due to the biasing force of the compression coil spring 22. In this case, the fan 19 keeps rotating for a predetermined period of time in spite of OFF state of the trigger switch 5 because of an operation of a control portion (not shown). In the state shown in FIG. 3, the first and second flow passages are provided at the upper side of the combustion-chamber frame 10, so that fresh air flows into the combustion chamber 26 through the intake port 3*a* formed in the head cover 3 and the residual gas is expelled through the exhaust port 2*a* by the rotation of the fan 19. Thus, the combustion chamber 26 is scavenged. Then, the rotation of the fan 19 is stopped to restore an initial stationary state. Thereafter, subsequent nail driving operation can be performed by repeating the above described operation process.

The coil spring 15 according to the above-described embodiment is covered with an elastic material such as rubber. Due to impact absorbing capability of the rubber, the impact imparted upon the motor can be attenuated or reduced without relying on the friction between the motor holder 13 and the motor holder receiving portion 11*a*.

The coil spring 15 may have an increasing diameter toward the lower portion of the same. The use of such a coil spring 15 enables the vertical distance between the motor holder 13 and the bottom portion of the motor holder receiving portion 11*a* to be shortened, thereby compacting the size of the nail driver 1.

A sleeve formed from resin such as plastic may be interposed between the inner peripheral surface of the motor holder receiving portion 11*a* and the outer peripheral surface of the motor holder 13 in order to attain sliding movement between the sleeve and the motor holder 13. With the provision of the sleeve that contacts the motor holder 13, the motor holder 13 can slidingly move with less friction. The material of the sleeve is selected from low frictional materials.

Figure 8:
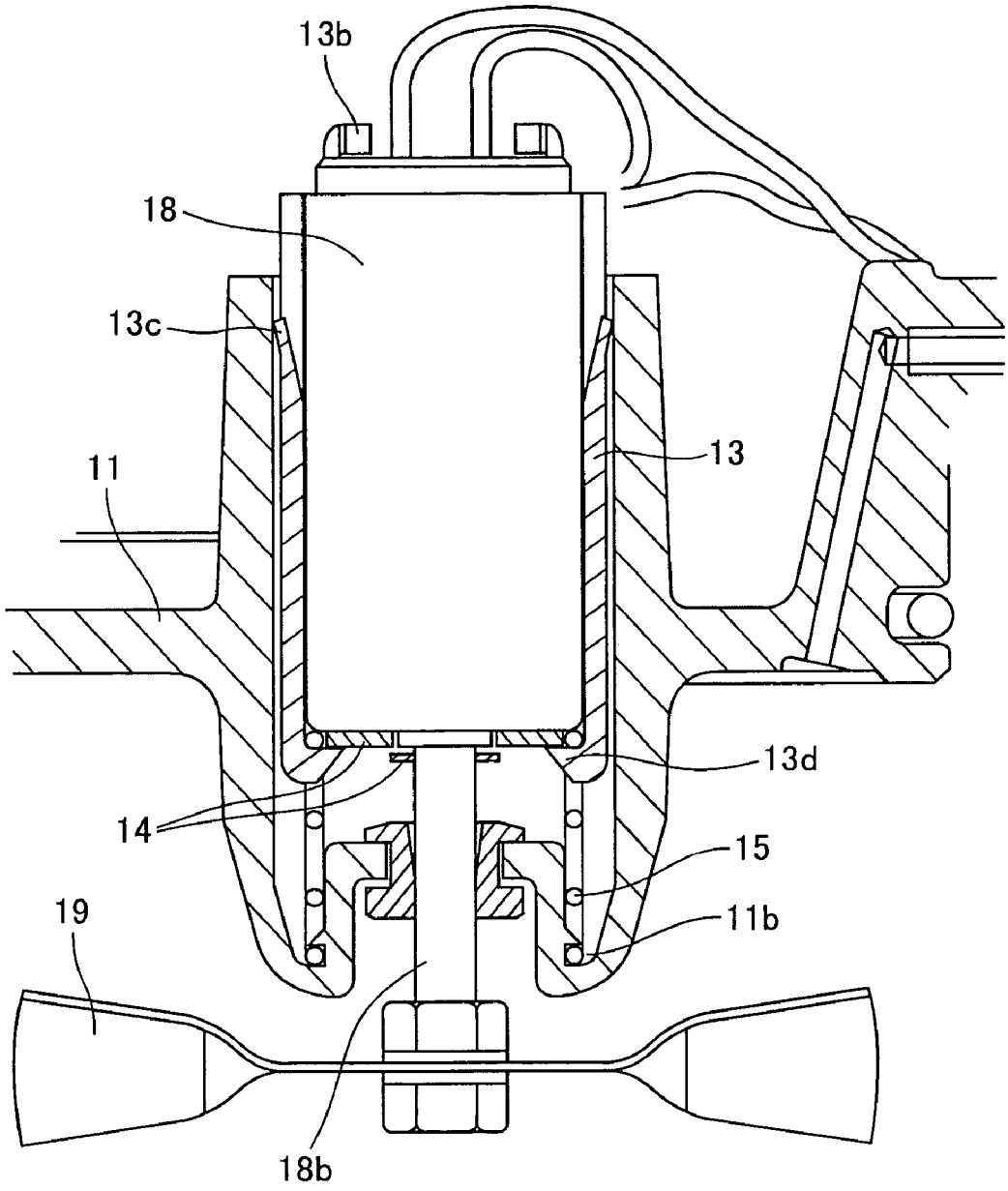
FIG. 8 is a cross-sectional view showing a cylinder head and its associated components according to a second embodiment of the present invention.

A motor holder employed in the combustion-type nail driver according to the second embodiment will be described while referring to FIG. 8. FIG. 8 is a vertical cross-sectional view showing the motor holder 13 and its associated components. A motor 18 is accommodated in the motor holder 13 formed from a material of a low friction factor such as plastic. The motor holder 13 is a hollow cylindrical member adapted to receive the motor 18. The motor 18 is supported by the motor holder 13 and the upper side of the motor 18 is fixed by hooks 13*b* provided above the motor holder 13. Three protrusions 13*c* protrude radially outwardly from the intermediate portion of the motor holder 13. The protrusions 13*c* are formed at the time of mold shaping the motor holder 13. The protrusions 13*c* perform up and down movements while contacting the inner wall of the motor holder receiving portion 11*a* formed in the cylinder head 11 when impact is imparted upon the motor 18. Friction between the protrusions 13*c* and the motor holder receiving portion 11*a* momentarily substantially absorbs the impact to be imparted upon the motor 18.

A groove 13*d* is formed in the bottom of the motor holder 13, to which the upper end portion of the coil spring 15 is attached. The lower end portion of the coil spring 15 is attached to the groove 11*b* formed in the bottom of the motor holder receiving portion 11*a*. The coil spring 15 interposed between the motor 18 and the cylinder head 11 serves to suppress the initial acceleration applied to the motor 18.

Figure 9:
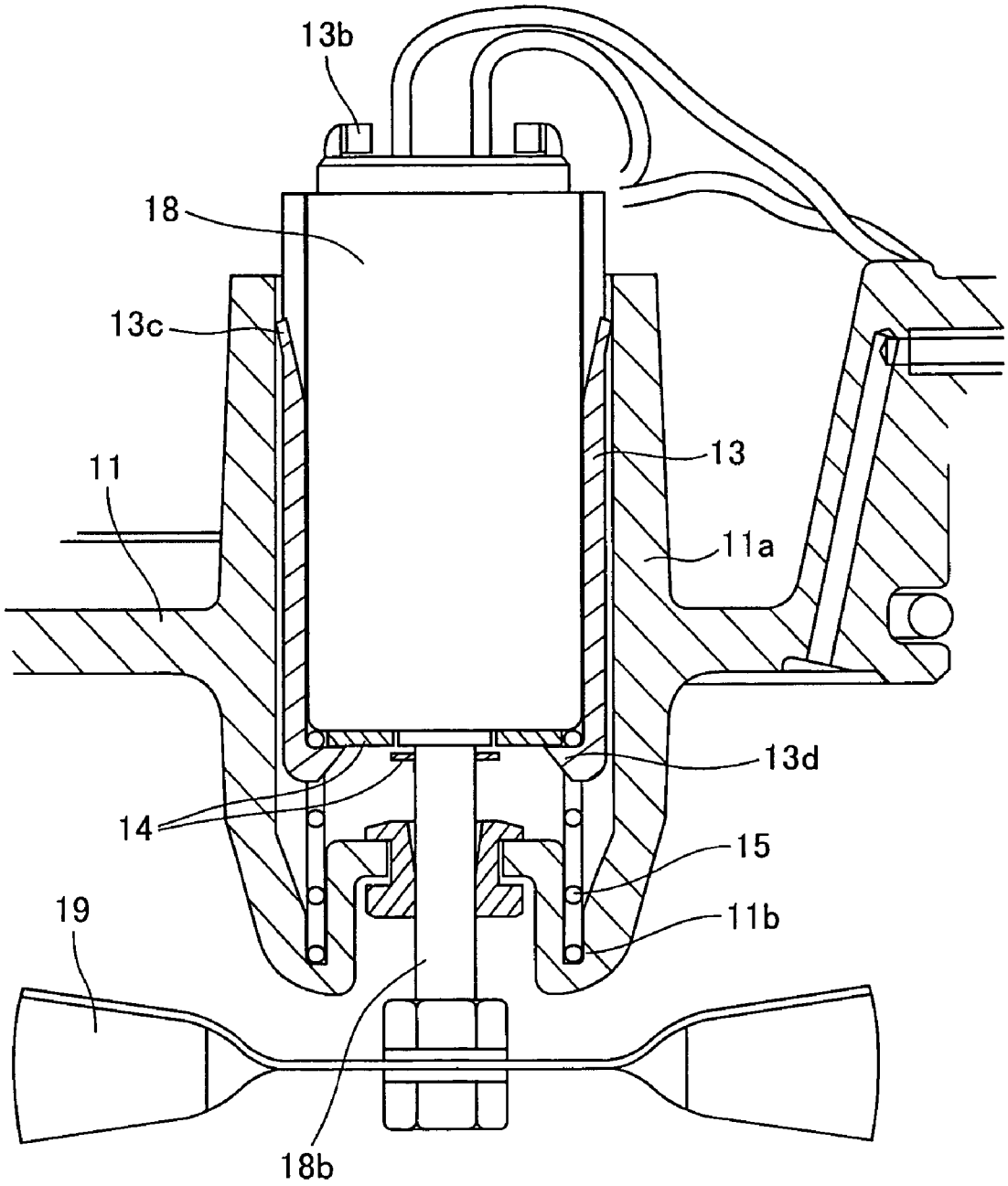
FIG. 9 is a cross-sectional view showing a cylinder head and its associated components according to a third embodiment of the present invention.

A motor holder employed in the combustion-type nail driver according to the third embodiment will be described while referring to FIG. 9. FIG. 9 is a vertical cross-sectional view showing the motor holder and its associated components. In the third embodiment, one end of the coil spring 15 is force-fitted into the groove 11*b* formed in the motor holder receiving portion formed in the cylinder head 11, thereby supporting the motor holder 13 on the cylinder head 11. According to the above-described holding method, machining the cylinder head 11 can be achieved easily because the shape of the groove 11*b* formed in the cylinder head 11 does not require a complicated spring capturing capability.

Figure 10:
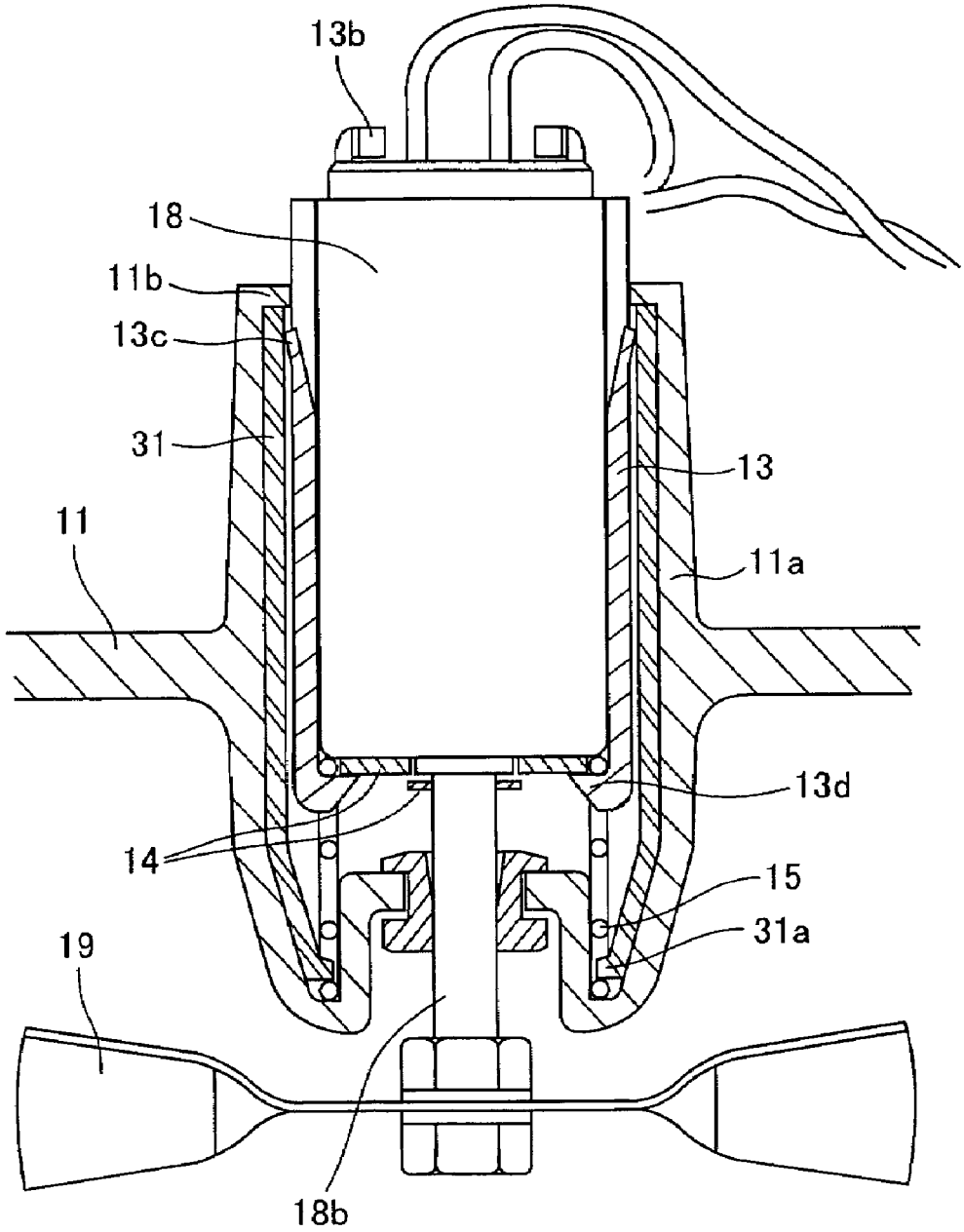
FIG. 10 is a cross-sectional view showing a cylinder head and its associated components according to a fourth embodiment of the present invention.

A motor holder employed in the combustion-type nail driver according to the fourth embodiment will be described while referring to FIG. 10. FIG. 10 is a vertical cross-sectional view showing the motor holder and its associated components. The fourth embodiment shows how to hold the coil spring 15 in the motor holder receiving portion 11*a*. An annular end holding part lid is formed in the upper end of the motor holder receiving portion 11*a* for holding a sleeve 31. The sleeve 31 has an outer diameter approximately equal to the inner diameter of the motor holder receiving portion 11*a*. The sleeve 31 inserted into the motor holder receiving portion 11*a* holds the coil spring 15 in the motor holder receiving portion 11*a*. According to the above-described holding method, assembling of the motor 18 and its associated components can be performed easily because insertion of the sleeve 31 into the motor holder receiving portion 11*a* enables holding of the coil spring 15. Further, by changing the material of the sleeve 31, friction between the sleeve 31 and the motor holder 13 can be adjusted.

A combustion-type nail driver according to the fifth embodiment will be described while referring to FIGS. 11 through 14. The nail driver shown in FIGS. 11 through 14 is basically the same in structure as that shown in FIGS. 3 through 7 but differs therefrom in the material and shape of the motor holder 13.

Figure 13:
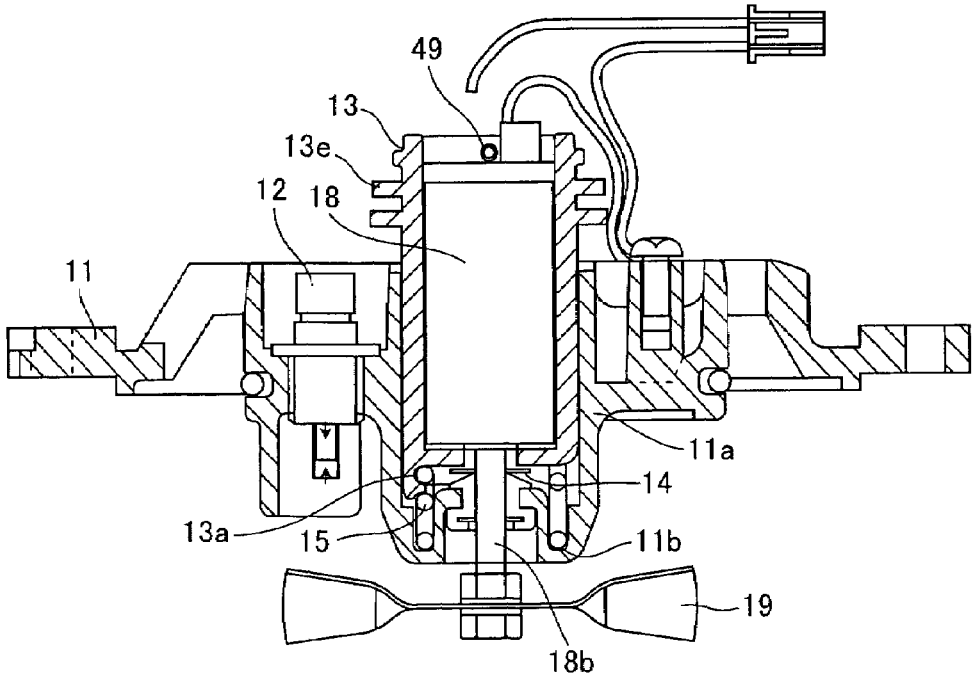
FIG. 13 is a cross-sectional view showing a cylinder head and its associated components according to the fifth embodiment of the present invention.

The motor holder 13 according to the fifth embodiment is formed from a metal such as aluminum. The metallic motor holder 13 is imposed on a role of dissipating combustion heat generated at the time firing the nails and also heat generated from the motor 18. As shown in FIG. 13, the motor 18 is inserted from the upper end of the motor holder 13 and held therein with a pin 49 so as not to be detached therefrom. One end of the coil spring 15 is inserted into and held by the groove 13*a* formed in the bottom of the motor holder 13. Another end of the coil spring 15 is inserted into the groove 11*b* engraved in the motor holder receiving portion 11*a* and is fixed thereto by a screw 32.

Figure 11:
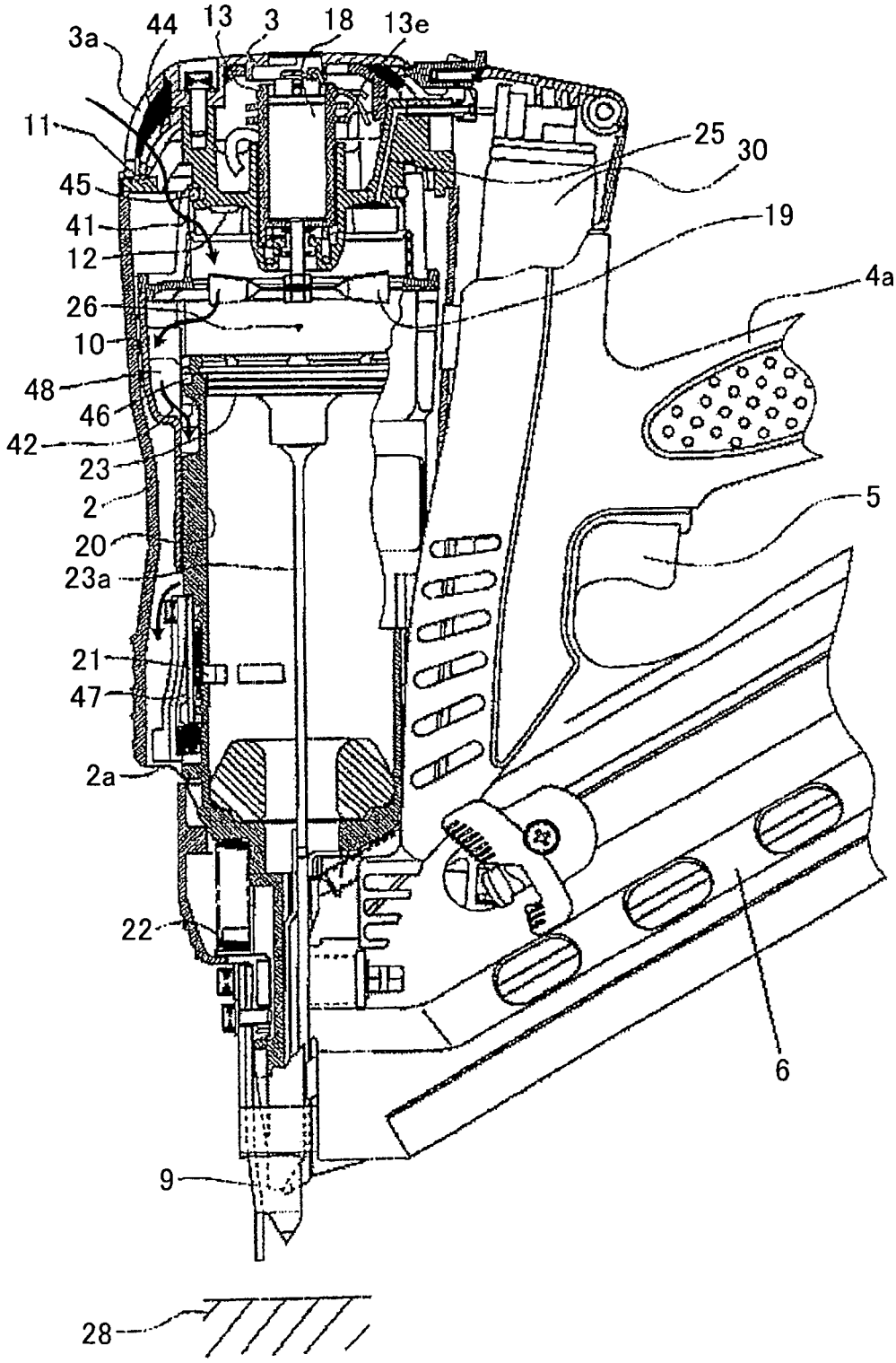
FIG. 11 is a cross-sectional side view showing a combustion-type nail driver according to a fifth embodiment of the present invention.

FIG. 11 shows an initial state of the nail driver 1, in which the nail driver 1 has not yet been operated. Air flow or combustion gas flow is created by the fan 19 at the time of scavenging. Air is introduced into the intake port 3*a* from the upper side of the head cover 3, flows along the first flow passage 41, and then enters into the combustion chamber 26 via the fan 19. Combustion gas remaining in the combustion chamber 26 is expelled out of the combustion chamber 26, passes along the second flow passage 42, flows in the outer periphery of the cylinder 20, and discharged out of the housing 2 from the exhaust port 2*a* formed in the lower portion of the housing 2.

The motor 18 for rotating the fan 19 is accommodated in the motor holder 13 made from a metal such as aluminum. The motor holder 13 and the motor holder receiving portion 11*a* formed in the cylinder head 11 are connected together with an elastically deformable coil spring 15 interposed therebetween. The coil spring 15 serves to prevent impact generated at the time of firing the nails from being directly transmitted to the motor 18.

The metallic motor holder 13 effectively dissipates heat generated at the time of operation of the nail driver and heat generated from the motor 18, thereby suppressing the temperature rise of the motor 18. Further, cooling fins 13*e* are formed in the outer circumference of the motor holder 13 for enhancing the heat dissipation.

Figure 12:
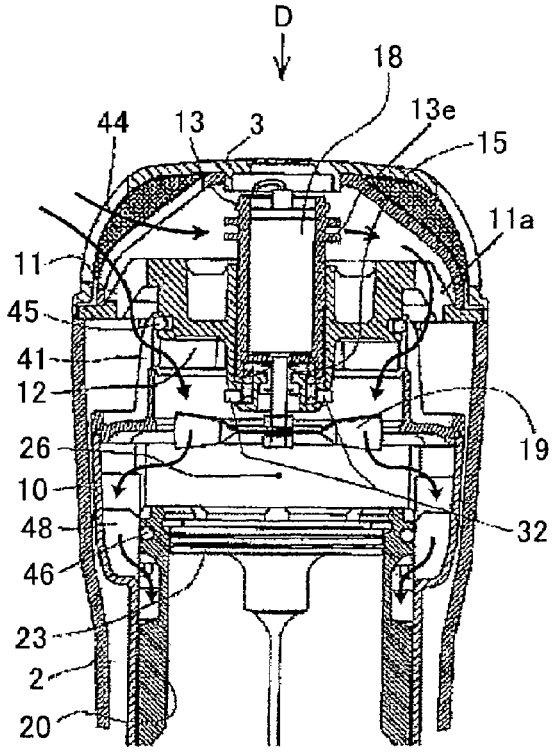
FIG. 12 is a partial enlarged diagram of the combustion-type nail driver shown in FIG. 11.
Figure 14:
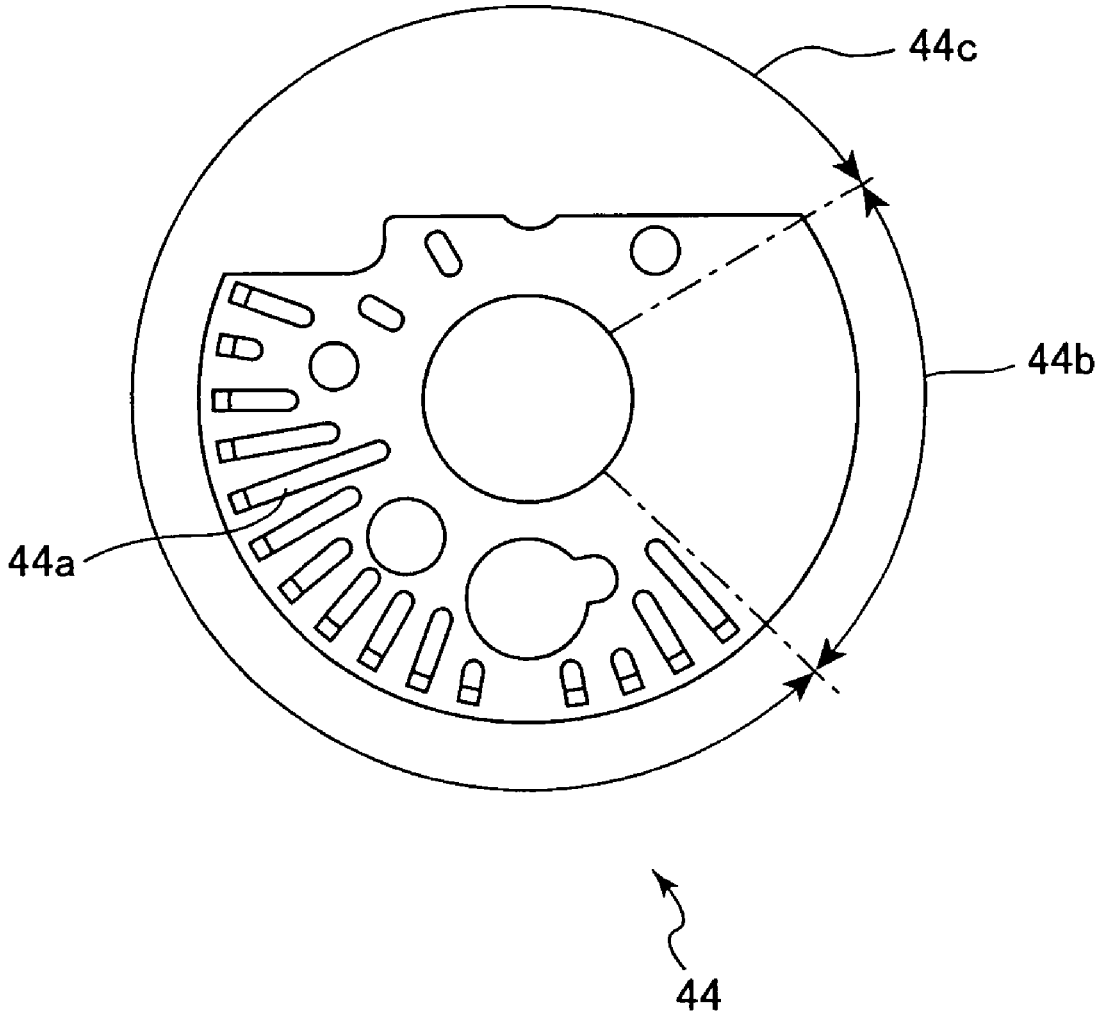
FIG. 14 is a top view showing a head protector as viewed from a direction D shown in FIG. 12.

FIG. 12 is a cross-sectional view showing the upper portion of the nail driver 1 as view from a direction in which the nail driver 1 is rotated 90 degrees about the motor output shaft from the state shown in FIG. 11. A head protector 44 is provided inside the head cover 3. FIG. 14 shows the head protector 44 as viewed from direction D shown in FIG. 12. The head protector 44 is substantially cone-shaped and formed from plastic. The head protector 44 includes a communication part 44*c* and a guide part 44*b*. A plurality of scavenging holes 44*a* is formed in the communication part 44*c* for allowing air to pass therethrough at the time of scavenging. The guide part 44*b* is such a portion where no scavenging holes 44*a* are formed.

When the fan 19 rotates to create an air flow, air is sucked from the intake port 3*a* formed in the head cover 3. The air thus sucked flows into the opening 11*a* of the cylinder head 11 via the scavenging holes 44*a* formed in the head protector 44. If the scavenging holes 44*a* are positioned immediately above the opening 11*a* of the cylinder head 11, air flows vertically downward. However, since the guide part 44*b* is positioned immediately above the opening 11*a* of the cylinder 11, air sucked from the intake port 3*a* flows into the opening 11 of the cylinder head 11 while passing by the motor holder 13. Accordingly, with the provision of the head protector 44, cooling the motor holder 13 can effectively be performed.

With the structure as described above, and as shown in FIG. 12, the air flow at the time of scavenging is that the air sucked from the intake port 3*a* passes by the cooling fins 13*e* formed in the upper portion of the motor holder 13, guided by the guide part 44*b* where no scavenging holes 44*a* are formed, and then introduced into the combustion chamber 26. As such, the fresh air passes by the upper portion of the motor holder 13, whereby the temperature rise of the motor 18 can further be suppressed.

While the invention has been described in detail with reference to specific embodiments thereof, it would be apparent to those skilled in the art that various changes and modifications may be made therein.

What is claimed is:

1. A combustion-type power tool comprising:

a housing;

a cylinder head disposed at one end of the housing;

a cylinder in the housing;

a piston slidably disposed in the cylinder;

a driver blade connected to the piston;

a combustion-chamber provided in the housing;

a fan disposed in the combustion chamber;

a motor having an output shaft coupled to the fan;

a motor holder that accommodates the motor, the cylinder head being formed with a motor holder receiving portion in which the motor holder is slidably movably disposed; and an elastic member disposed in a gap formed between the motor holder and the motor holder receiving portion;

wherein the elastic member extends in an axial direction of the output shaft and is in contact with both the motor holder and the motor holder receiving portion in the axial direction.

2. The combustion-type power tool according to claim 1, wherein the elastic member is disposed in a gap at least partially surrounding a portion of the output shaft of the motor coupled to the fan.

3. The combustion-type power tool according to claim 1, wherein the elastic member is a coil spring.

4. The combustion-type power tool according to claim 3, wherein the coil spring extends in an axial direction of the output shaft of the motor coupled to the fan.

5. The combustion-type power tool according to claim 1, wherein the gap is formed between a lower portion of the motor holder and a lower portion of the motor holder receiving portion.

6. A combustion-type power tool comprising:

a housing;

a cylinder head disposed at one end of the housing and having a bottom portion;

a cylinder in the housing;

a piston slidably disposed in the cylinder;

a driver blade connected to the piston;

a combustion-chamber provided in the housing;

a fan disposed in the combustion chamber;

a motor having an output shaft coupled to the fan, the bottom portion of the cylinder head being disposed below the motor for supporting the motor; and an elastic member disposed in a gap formed between the motor and the bottom portion of the cylinder head in an axial direction of the output shaft of the motor.

7. The combustion-type power tool according to claim 6, further comprising a motor holder that supports the motor and is slidably movable with respect to the cylinder head, the elastic member is disposed in a gap formed between the motor holder and the cylinder head in the axial direction of the output shaft of the motor.

8. The combustion-type power tool according to claim 7, wherein the motor holder has an outer periphery on which a plurality of protrusions is formed.

9. The combustion-type power tool according to claim 7, further comprising a low friction member interposed between the motor holder and a surface of the cylinder head on which the motor holder slidably moves, wherein the low friction member is made from a material having friction lower than friction of the surface of the cylinder head.

10. The combustion-type power tool according to claim 7, wherein the motor holder is formed from a metal.

11. The combustion-type power tool according to claim 10, further comprising a cooling fin formed in the motor holder.

12. The combustion-type power tool according to claim 10, further comprising a scavenging guide formed at an upper portion of the cylinder head, the scavenging guide including a communication part and a guide part.

13. The combustion-type power tool according to claim 6, further comprising a heat shielding member disposed between the motor and the cylinder head for blocking head wind generated in the combustion chamber and blown toward the motor.

14. The combustion-type power tool according to claim 6, wherein the elastic member is disposed in the gap formed between the motor and the bottom portion of the cylinder head which at least partially surrounds a portion of the output shaft of the motor coupled to the fan.

* * * * *